United States Patent [19]

Deschaaf

[11] 4,422,247

[45] Dec. 27, 1983

[54] LOW VOLTAGE SENSOR FOR A DRYER

[75] Inventor: Clifford L. Deschaaf, Lincoln Township, Berrien County, Mich.

[73] Assignee: Whirlpool Corporation, Benton Harbor, Mich.

[21] Appl. No.: 278,869

[22] Filed: Jun. 29, 1981

[51] Int. Cl.[3] ..... F26B 21/10

[52] U.S. Cl. ..... 34/48; 34/53; 34/55; 34/133

[58] Field of Search ..... 34/48, 53, 55, 133

[56] References Cited

U.S. PATENT DOCUMENTS

| | | | |
|---|---|---|---|
| 3,324,568 | 6/1967 | Nelson et al. | 34/45 |
| 3,497,964 | 3/1970 | Elders | 34/53 |
| 3,758,959 | 9/1973 | Karklys | 34/48 |
| 4,385,451 | 5/1983 | Wesley | 34/53 |
| 4,385,452 | 5/1983 | De Schaaf | 34/53 |

*Primary Examiner*—Larry I. Schwartz

*Attorney, Agent, or Firm*—Hill, Van Santen, Steadman & Simpson

[57] ABSTRACT

A fabric treating apparatus, such as a domestic clothes dryer, is provided with a digital control circuit and a sensor system which cooperate to terminate a fabric treatment operation when the fabric reaches a desired condition. A digital counter receives and accumulates timing pulses. A sensing circuit repetitively charges a capacitor which is allowed to discharge through a sensor in contact with the wet fabric load. If the fabric in contact with the sensor is wet, the capacitor will quickly discharge. As the fabric dries the capacitor will discharge more slowly. After the capacitor has been allowed to discharge for a preselected period, the charge on the capacitor is read and if low, the counter is reset. As the fabric load approaches the desired dryness condition, the remaining charge on the capacitor will increase until it reaches a level which prevents the counter from being reset. Thus, the counter accumulates successively greater counts before being reset, until eventually a preselected count is accumulated in the counter which triggers cicruitry to terminate the fabric drying operation.

9 Claims, 5 Drawing Figures

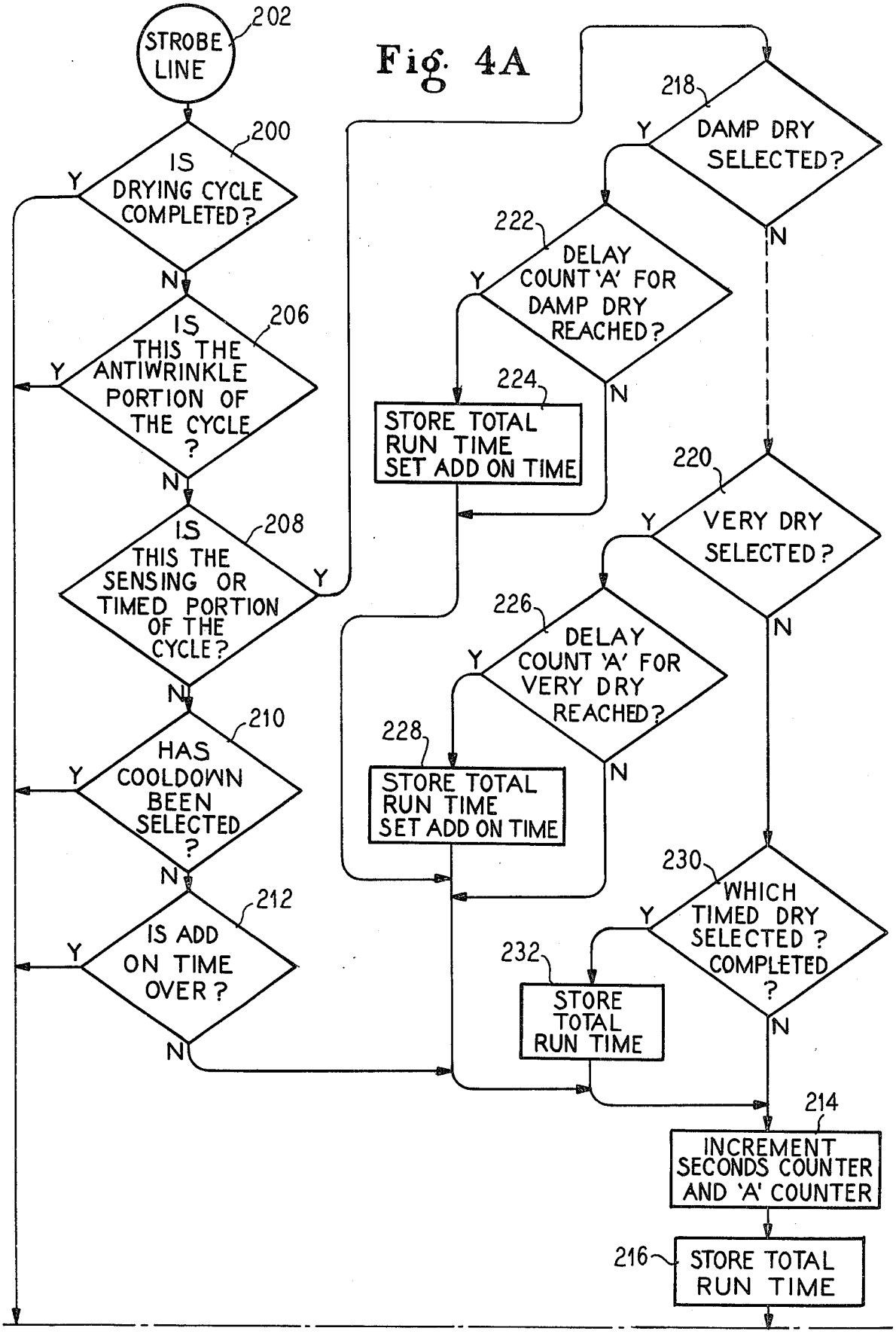
Fig. 4A
STROBE LINE
202
IS DRYING CYCLE COMPLETED?
200
IS THIS THE ANTIWRINKLE PORTION OF THE CYCLE ?
206
IS THIS THE SENSING OR TIMED PORTION OF THE CYCLE?
208
HAS COOLDOWN BEEN SELECTED ?
210
IS ADD ON TIME OVER ?
212
DAMP DRY SELECTED?
218
DELAY COUNT 'A' FOR DAMP DRY REACHED?
222
STORE TOTAL RUN TIME SET ADD ON TIME
224
VERY DRY SELECTED?
220
DELAY COUNT 'A' FOR VERY DRY REACHED?
226
STORE TOTAL RUN TIME SET ADD ON TIME
228
WHICH TIMED DRY SELECTED ? COMPLETED ?
230
STORE TOTAL RUN TIME
232
INCREMENT SECONDS COUNTER AND 'A' COUNTER
214
STORE TOTAL RUN TIME
216
Y
N

LOW VOLTAGE SENSOR FOR A DRYER

BACKGROUND OF THE INVENTION

1. Field of the Invention

This invention relates to the art of sensing and control techniques for laundry apparatus, and is particularly concerned with methods and apparatus for sensing the moisture content of a clothes load within a dryer and controlling the operation of the clothes dryer as a function thereof.

2. Description of the Prior Art

U.S. Pat. No. 3,702,030 discloses a high voltage sensor circuit for an integrated circuit control that produces repetitive pulses when the clothes load is dryer than a given dryness level for resetting a second counter to prevent the second counter from resetting a first counter. The first counter, upon reaching a predetermined count, ends the sense portion of the drying cycle. Similar circuits are utilized in U.S. Pat. Nos. 3,762,064 and 3,769,716.

U.S. Pat. No. 3,621,293 discloses the use of a field effect transistor for sensing voltage buildup on a capacitor in a drying control.

U.S. Pat. No. 3,221,417 discloses a moisture sensor control circuit. Rotating cams and a timer motor along with a motor driven rotor switch arm are utilized which successively closes circuits causing a capacitor to be charged. The capacitor is connected to a pair of spaced electrodes and then to a relay. If the charge on the capacitor does not discharge through the electrodes, it will remain to power the relay for terminating the drying operation.

SUMMARY OF THE INVENTION

The present invention provides a means of sensing clothes load moisture in a microcomputer controlled dryer based on the level of moisture retention measured in the clothes load.

A low voltage sensor circuit comprising a moisture sensor, a capacitor and a tri-stating port on a microcomputer is used to sense the degree of dryness of a load of clothes within the dryer. The sensor and capacitor are connected in parallel to the tri-stating port. The tri-stating condition of the tri-stating input/output port allows for three different conditions at the port. First, the port can output a voltage. Second, the port can present a high impedance. Third, the port can read an input voltage.

As utilized in the present invention, first a charge is applied to the capacitor by the port in the output mode. The port is then tri-stated to its very high impedance input stage. Thus, the capacitor can only discharge through the sensor which is located within the drum of the dryer where it can contact the clothes load. If moisture is sensed by means of wet clothes bridging the sensor, the capacitor will discharge rapidly. If the clothes load is dry or no clothes touch the sensor, the charge will tend to remain in the capacitor.

Next, after a preselected time interval, the state of the port is changed to receive an input voltage from the capacitor. After reading the charge, the port outputs the voltage which recharges the capacitor and the process repeats. The discharge time, when the port is tri-stated, along with the value of the capacitor, will determine the voltage remaining on the capacitor for a given level of clothes dryness.

If a low voltage is read by the input port, this represents a wet signal and causes a counter to be reset. If a high voltage is read, this represents a dry signal and the counter continues to accumulate counts. As the clothes load continues to dry, wet signals will decrease until a sufficient length of time between wet signals occurs allowing the counter to accumulate a preselected count. When this occurs, the sensing portion of the drying process will end and the control circuit will cause the remainder of the selected program to continue.

BRIEF DESCRIPTION OF THE DRAWINGS

FIGS. 4*a* and 4*b* comprise a flow chart illustrating the operation of a low voltage sensor control process.

DESCRIPTION OF THE PREFERRED EMBODIMENTS

Figure 1:
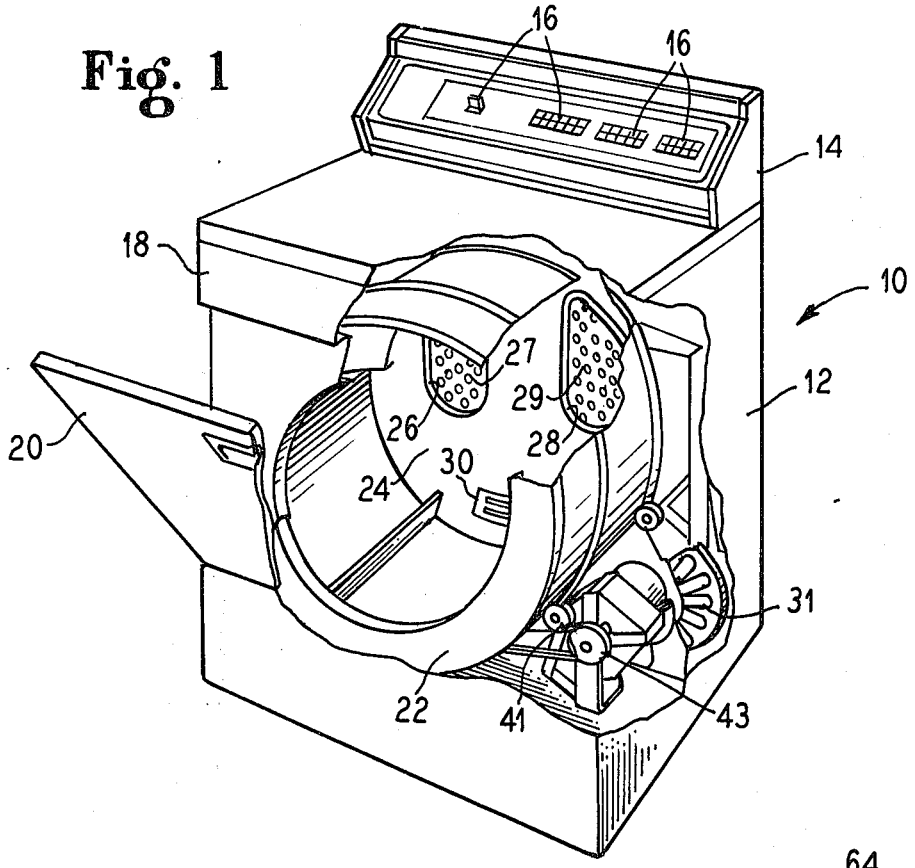
FIG. 1 is a perspective view of an automatic dryer embodying the principles of the present invention.

In FIG. 1 there is generally shown an automatic dryer 10 having a cabinet 12 and a control console 14 with a plurality of presettable controls 16 thereon. Each of the controls 16 may take the form of touch control switches. However, the controls 16 may be of any number of types commonly known in the art without departing from the spirit of the invention. The controls 16 provide the operator with the opportunity of preselecting a special custom mode of operation such as fabric selection, automatic dry, timed dry, air and touch-up drying cycles. A range of selections are available in each of the automatic and timed dry cycles.

A front 18 of the cabinet 12 has a door 20 which provides access to a treatment zone in the interior of the dryer 10 including a rotatable drum 22. Provided in a rear stationary bulkhead at the rear of the drum 22 there is an inlet aperture 26 with a screen or perforate cover plate 27 across the aperture 26 and an air outlet aperture 28 formed by perforations 29 in bulkhead 24 through which a supply of temperature conditioned air is circulated by a blower or fan 31 during the drying process.

Figure 2:
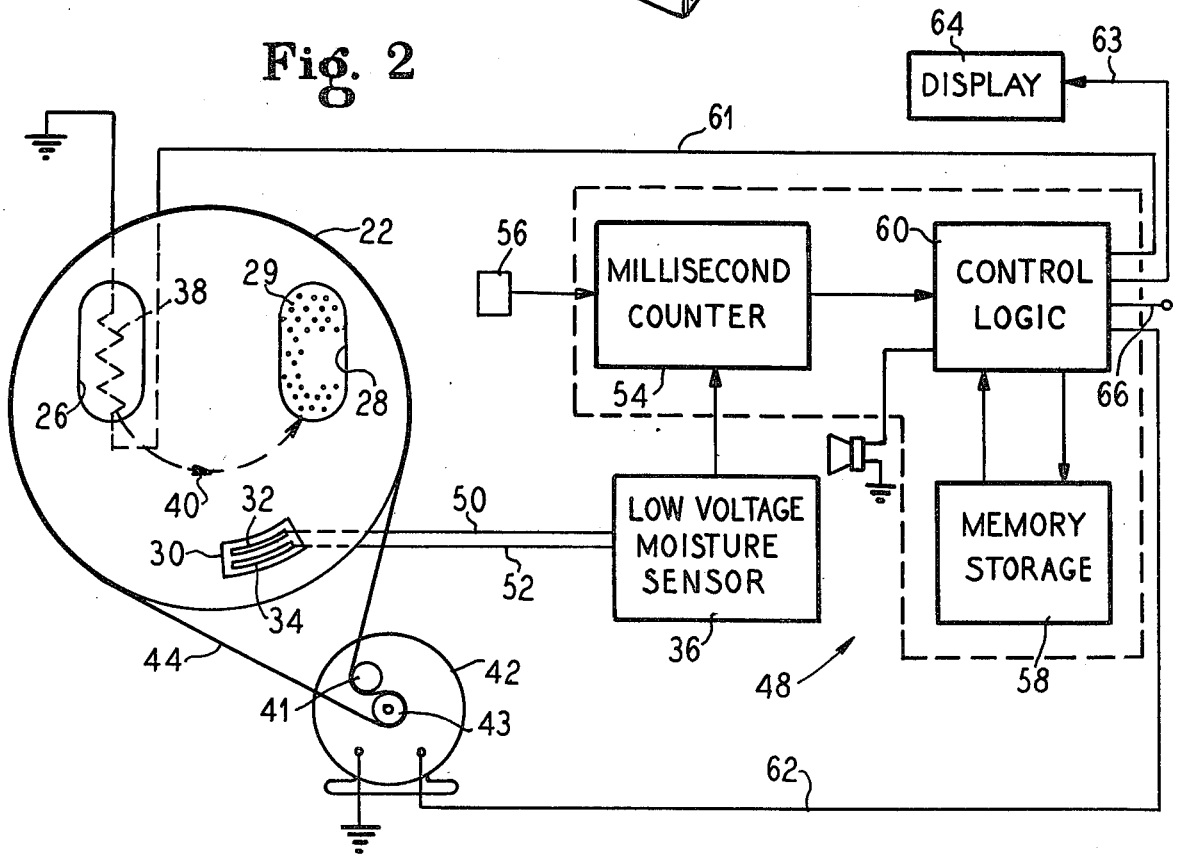
FIG. 2 is a schematic diagram of a dryer including a dryer control circuit according to the present invention.

As seen in FIG. 2, a heating element 38 is provided in the air flow path designated by broken arrow 40 which is selectively energized by a control logic circuit 60 to selectively temperature condition the air to the interior of the dryer 10 as required, thereby conditioning the air to take on increased moisture. Blower 31 is connected in an air flow relationship with the air inlet and outlet apertures so that air is drawn into the drum 22 by way of the aperture 26 after first passing the heating element 38 and is withdrawn from the drum through the aperture 28. An electric motor 42 drives the blower 29 and is also provided to rotate the drum 22 by means of a drive pulley 43, a tensioning idler pulley 41 and a belt 44.

At least one sensor 30 is provided which can be in contact with the clothes load during the drying operation while the drum is rotating. The sensor 30 is comprised of two electrodes 32 and 34 which are connected by a pair of conductors 50, 52 to a low voltage moisture sensor circuit 36 as shown in FIG. 2

A digital control circuit is generally shown at 48 and includes the sensor circuit 36 which is connected to the sensor electrodes 32, 34, a digital millisecond counter circuit 54 which is driven by a timing crystal 56, a memory storage 58 and the control logic circuit 60 for reading the states of a counter 54 and the stored values in the memory storage 58 for indexing the memory storage 58.

The control logic circuit 60 includes a plurality of outputs for controlling various machine functions and, accordingly, for controlling the program of the dryer. A first output is indicated by the electrical connection line 61 which extends from the control logic circuit 60 to the heating element 38 for controlling the application of heat to the interior of the drum 22. A second output is indicated by means of an electrical connection line 62 which extends from the control logic circuit to the electrical drive motor 42 for controlling rotation of the drum 22 and the fan.

A third output is indicated by means of an electrical connection line 63 which extends from the control logic circuit 60 to a display circuit 64 which controls a number of indicator lamps behind the panel on the console 14 of the dryer 10 to indicate to the operator which drying functions have been selected and in which portion of the drying cycle the dryer is currently operating. Another output is evidenced by the electrical connection line 66 which may be employed, for example, as a master power control lead for disconnecting the circuits from the electrical supply at the termination of the drying program.

As will be appreciated by those skilled in the art, the electrical connections 61, 62, 63, and 66 are in schematic form only, and in practice appropriate interface circuitry such as is well known in the art would be necessary to enable the relatively low level signals developed by the logic circuitry to be used to control the power supply to the machine components.

Figure 3:
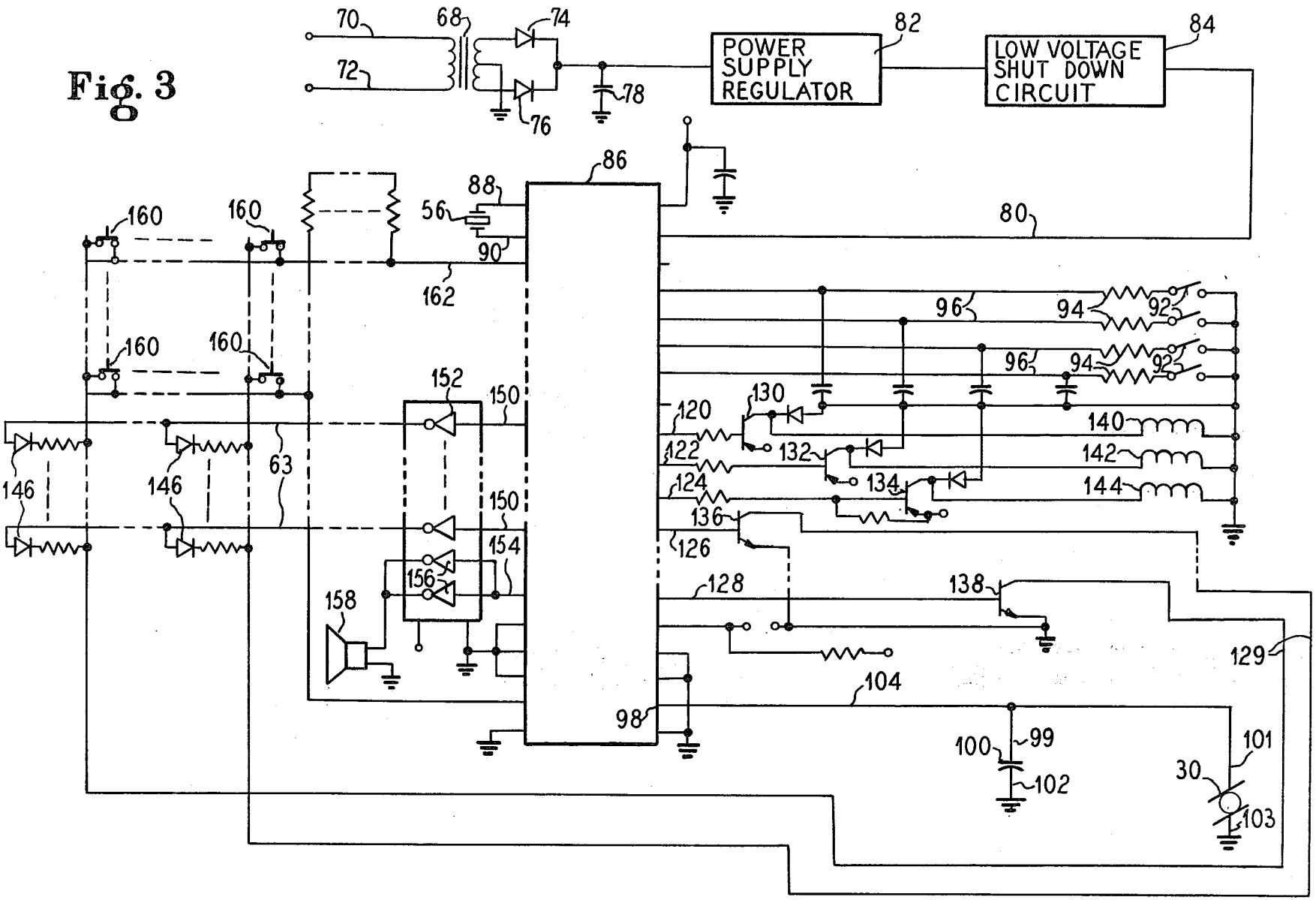
FIG. 3 is a schematic electrical circuit diagram utilized in the present invention.

FIG. 3 details the electrical circuitry utilized in the present invention. A transformer 68 is connected to a source of 120 volt alternating current by conductors 70 and 72. The alternating current is rectified to direct current by means of diodes 74 and 76. A capacitor 78 to protect against voltage spikes, a power supply regulator 82, and a low voltage shut down circuit 84 are provided in a power line conductor 80 to insure a constant voltage level is supplied to a microprocessor or microcomputer 86. The timing crystal 56 supplies a timing pulse to the microcomputer along conductors 88, 90. A plurality of input switches 92 are connected through resistors 94 and conductors 96 to the microcomputer 86 in order to alert the microcomputer as to certain conditions such as an open door or a filled lint receptacle.

Output signals or conductors 120, 122 and 124 are sent through drivers 130, 132 and 134 to operate relays 140, 142 and 144 which send appropriate signals along lines 61, 62 and 66 to the heating element, motor and master switch as described above.

Output signals are also sent on a series of conductors representatively shown by lines 126 and 128 which are strobed through transistors 136 and 138 alternatingly providing closed circuits along a plurality of conductors 129 for various LED's 146 in the display circuit 64. The lines 126 and 128 represent any number of conductors which are multiplexed to reduce the power requirements of the display circuit.

Output signals from the microcomputer 86 also are sent on a plurality of conductors 150 through driver amplifiers 152 and on a plurality of conductors 63 to energize the appropriate LED's 146. Output signals are also sent on a conductor 154 through drivers 156 to energize an end of cycle alarm 158 at the end of the drying cycle.

A plurality of input switches 160 form a part of the controls 16 which are provided for the operator to make the appropriate selections of the various drying cycle operation options. These input signals are supplied to the microcomputer 86 through a plurality of conductors 162.

The sensing circuit 36 utilizes a tri-stating input/output port 98 of the microcomputer 86 such as provided on the S-2000 microcomputer family manufactured by American Microsystems, Inc. The tri-stating port 98 is connected by a conductor 104 to a first terminal 99 of a capacitor 100 and a first terminal 101 of the moisture sensor 30. A second terminal 102 of capacitor 100 and a second terminal 103 of the sensor 30 are both connected at all times to a reference potential such as ground.

The tri-stating condition of the port 98 allows for three different conditions. First, the port 98 can output a voltage. Second, the port can present a high impedance. Third, the port can read an input voltage.

As utilized in the present invention, first the port 98 outputs a voltage on line 104 which charges capacitor 100. However, if there are wet clothes in contact with the sensor 30, then the current will flow through the sensor 30 to ground and the capacitor 100 will not fully charge.

After the port 98 has output a voltage it then is tristated so that it presents a very high impedance. This condition is continued for a preselected length of time, for instance one second, during which time the capacitor 100 can only discharge through the sensor 30. If wet clothes are in contact or come in contact with the sensor 30 during this period, the capacitor 100 will discharge. If no clothes or dry clothes are in contact with the sensor 30, then the capacitor 100 will remain charged.

At the end of the preselected time the condition of the port is changed so that it reads the charge on the capacitor 100. If a low voltage or charge is read, this is interpreted as a wet signal which causes an accumulation counter to be reset as will be described below. If a high voltage or charge is read, this is interpreted as a dry signal which allows the accumulation counter to continue to count.

After the port 98 has read the charge on the capacitor 100, it again outputs a voltage and repeats the operation throughout the entire portion of the drying cycle.

Figure 4B:
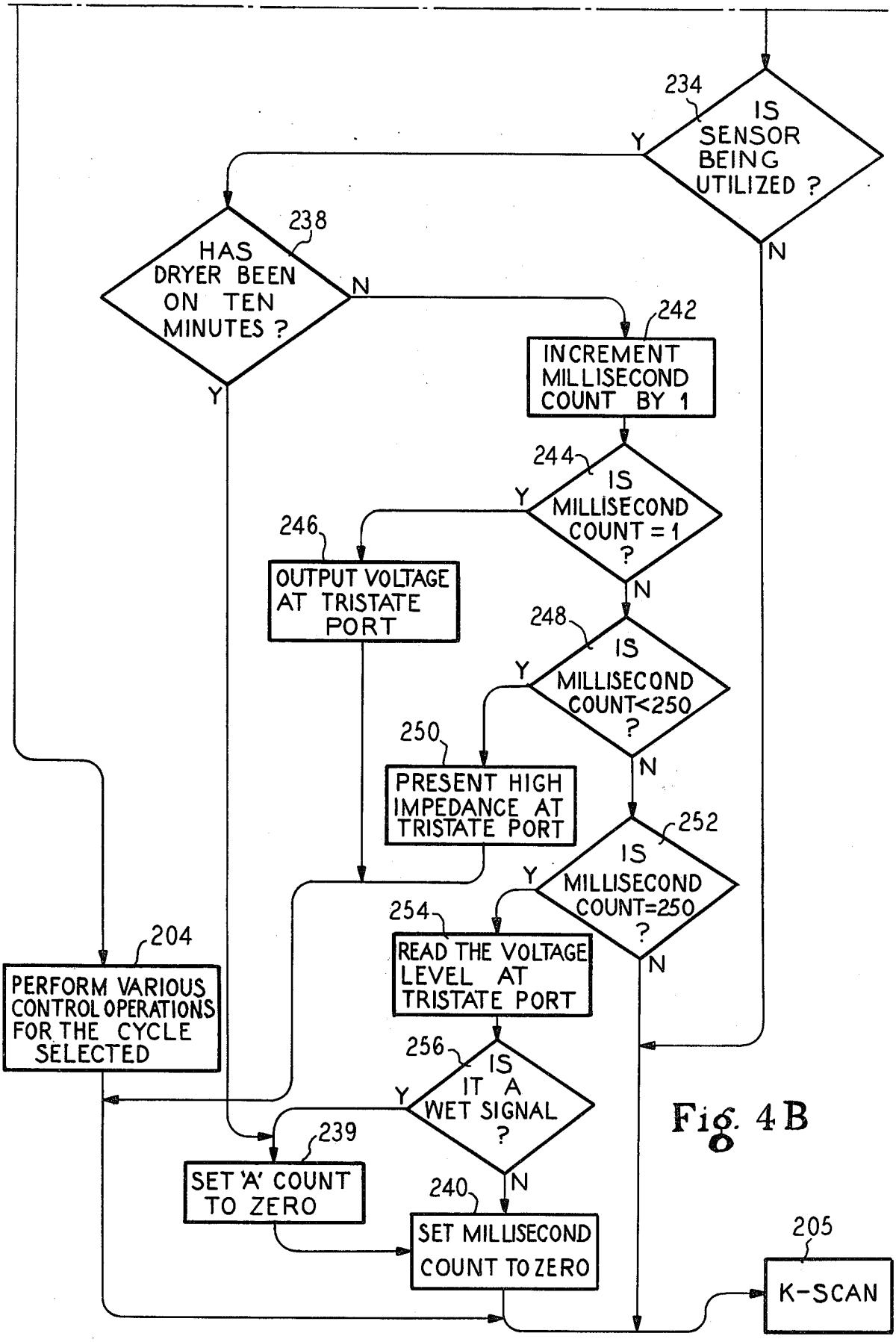

FIGS. 4*a* and 4*b* illustrate the operation of the apparatus of the present invention during an automatic cycle of operation. FIGS. 4*a* and 4*b* are in functional block diagram form, with the various blocks indicating steps performed in sequence during the performance of the method of the present invention, and also indicating the structure which is employed during the operation of the dryer. Although a preferred embodiment of the present invention employs a microcomputer controller for the performance of the dryness sensing controlling program, the present invention also contemplates an organization in which each of the blocks illustrated in FIGS. 4*a* and 4*b* corresponds to an individual control unit. Control of the operation is passed from control unit to control unit, to execute the program in its proper sequence. The operation proceeds by a sequence of steps.

The first step in the performance of the automatic operation of the dryness sensing control is by control unit 200 which is periodically energized from a strobe line 202. The microcomputer 86 as utilized in the present invention has four strobing circuits under control of a strobing or K-scan unit 205, one of which (202) is devoted to the sensing and time dry portion of the drying cycle. The other three strobes control the scanning of the inputs and the selections of the output relays and the output lights.

Control unit 200 inspects the drying cycle selections to determine if the drying cycle is complete. If the drying cycle is complete, then control is passed to unit 204 which performs the various control operations for the cycle selected before returning the strobe line to the K-scan unit 205. If control unit 200 determines that the drying cycle is not complete, then control is passed to unit 206.

Control unit 206 inspects the cycle selections to determine if the dryer is currently in the anti-wrinkle portion of the cycle. If unit 206 determines that it is, then control is passed again to unit 204 which would perform the control operations for the anti-wrinkle portion of the cycle before returning the strobe line to the K-scan unit 205. If control unit 206 determines that the dryer is not in the anti-wrinkle portion of the cycle, then control is passed to unit 208.

Control unit 208 inspects the cycle selections to determine if the dryer is in the sensing or timed portion of the cycle. If unit 208 determines that it is not, then control is passed to unit 210 which inspects the cycle selections to determine if the cool down option has been selected. If unit 210 determines that it has, then control is passed again to unit 204 which would perform the control operations for the cool down cycle prior to returning the strobe line to the K-scan unit 205.

If control unit 210 determines that cool down has not been selected, then control is passed to unit 212 which inspects the cycle selections to determine if add-on time is over. If unit 212 determines that it is, then control is passed to unit 204 to perform the various control operations for the cycle selected. If unit 212 determines that the add-on time is not over, then control is passed to unit 214 which increments a seconds counter in control logic 60 which keeps track of total run time and an A counter in control logic 60 which is used to determine if the clothes load has reached a selected level of dryness. Then control is passed to a unit 216 which stores the total run time.

If control unit 208 determines that the dryer is in the sensing or timed portion of the cycle, then control is passed to unit 218 which inspects the cycle selections to determine if the damp dry dryness level has been selected. If unit 218 determines that damp dry has not been selected, then control is passed through a series of units ending with unit 220 which inspects the cycle selections to determine if the very dry level of dryness had been selected.

Although only two dryness level inquiries, damp dry and very dry, have been shown in FIG. 4*a* as performed by units 218 and 220, it should be understood that any number of dryness levels may be utilized in the program which would allow an operator to select from a range of dryness levels for the fabrics being treated in the dryer. The following control unit functions would be the same for any level of dryness selected.

If control unit 218 determines that the damp dry level has been selected, control would be passed to unit 222 which inspects counter A to determine if a preselected delay count A for damp dry has been reached. The delay count A is a given interval of time in which the sensor 30 has not recorded a valid wet signal. As an example, the delay count A for damp dry could be 15 seconds.

If control unit 222 determines that delay count A for damp dry has been reached, then control is passed to unit 224 which stores total run time to be used in setting the cool down time by unit 204. Unit 224 also sets an add-on time in accordance with the procedure disclosed in U.S. Pat. No. 3,762,064 issued to Carl R. Offutt on Oct. 2, 1973 and assigned to the Whirlpool Corporation, the disclosure of which is incorporated herein by reference. After control unit 224 has stored the count and set the add-on time, control is passed to the unit 214 which increments the seconds counter and the A counter and then passes control to unit 216 which stores the total run time. If control unit 222 has determined that the delay count A for damp dry has not been reached, then control is passed directly to unit 214.

If any of the other levels of dryness, such as very dry, have been selected, the same steps would be performed by control units as are performed by units 218, 222, and 224. Specifically, control unit 220 determines if the very dry level has been selected. If it has, then control is passed to unit 226 which inspects counter A to determine if delay count A for very dry has been reached. As an example, the delay count A for very dry could be two minutes.

If control unit 226 determines that delay count A for very dry has been reached, then control is passed to unit 228 which stores the total run time and sets the add-on time as described with reference to unit 224. Then control is passed to unit 214 as described above. If control unit 226 determines that delay count A for very dry has not been reached, then control is passed directly to unit 214.

If control has passed from unit 218 through all of the various dryness level control units to unit 220 and control unit 220 determines that the very dry level has not been selected, then control is passed to unit 230 which inspects the cycle selectors to determine which timed dry period has been selected and it inspects the total run time stored by unit 216 to determine if the time period has completely elapsed. If the control unit 230 determines that the time has elapsed, control is then passed to unit 232 which stores the total run time to be used by unit 204 in determining the cool down time and control is passed to unit 214. If control unit 230 determiens that the time period has not completely elapsed, then control is passed directly to unit 214.

As described above, control unit 214 increments the seconds counter and the A counter and then passes control to unit 216 which stores the total run time. Control is then passed to unit 234. Control unit 234 determines if the sensor 30 is being utilized. If unit 234 determies that the sensor is not being utilized, then control is returned to the K-scan.

If control unit 234 determines that the sensor is being used, then control is passed to unit 238 which inspects the total run time stored by unit 216 to determine if the dryer has been on for ten minutes. The ten minute initial run time allows the dryer and the clothes load to reach a minimum drying time required for any small clothes load. If the dryer has been on for less than ten minutes, then control is passed to units 239 and 240 which rest the A counter to zero and a milliseconds count equal to zero, respectively. Control is then passed to unit 205 for returning the strobe line to the K-scan.

If control unit 238 determines that the dryer has been on for at least ten minutes, then control is passed to unit 242 which increments the milliseconds count by one, representing four milliseconds. A millisecond counter is utilized to control the condition of port 98 of the microcomputer 86 by keeping track of the time used for each of the three conditions of the port. In the preferred embodiment, four strobe lines are utilized and each strobe uses one millisecond, therefore each time the K-scan storbes line 202 and passes through this portion of the program, four milliseconds have elapsed. Thus, control unit 242 increments the milliseconds by four for each increment in its count.

Control is then passed to unit 244 which inspects the millisecond counter to determine if the millisecond count is equal to one. If it is, then control is passed to unit 246 which outputs the preselected voltage at port 98. Control is then pased to the K-scan unit 205.

If unit 244 determines that the millisecond count is not equal to one, then control is passed to unit 248 which inspects the millisecond counter to determine if the millisecond count is less than 250 representing 1,000 milliseconds. If it is, then control is passed to unit 250 which presents a high impedance at port 98. Control is then passed to the K-scan unit 205.

If unit 248 determines that the millisecond count is not less than 250, then control is passed to unit 252 which inspects the millisecond counter to determine if the millisecond count is equal to 250. If it is, then control is passed to unit 254 which reads the voltage level at the port 98. Control is then passed to unit 256 which inspects the voltage read by unit 254 to determine if there is a wet signal.

If unit 256 determines that there is a wet signal, the control is passed t o unit 239 which resets the "A" counter to zero. Control is then passed to unit 240 which resets the millisecond count to zero. If unit 256 determines that there is not a wet signal, control is passed directly to unit 240 to reset the millisecond counter. Control is then passed from unit 240 to the K-scan unit 205.

The strobing continues until the "A" counter delay has been reached indicating that the dryness level selected has been reached and then the program moves on into the add-on and cool down and/or anti-wrinkle cycle selected, control unit 204 performing the various control operations for the cycle selected. After unit 204 has performed the various control operations, control is passed to the K-scan unit 205.

Thus, it is seen that there is provided a low voltage moisture sensor for a dryer which senses the moisture content in the clothes load and sends an appropriate signal to a microcomputer for use in timing and control functions. A first counter is utilized to measure the time since a last wet signal has been sent. A second millisecond counter is utilized in controlling the condition of the tri-stating port. The first counter is reset each time that a wet signal has been sent. The first counter continues to count, in the absence of a wet signal, until a preselected level of dryness has been sensed.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A control circuit for a dryer comprising:
a source of timing pulses;
a resettable counter arranged to be incremented in accordance with said timing pulses;
moisture sensing means operative to sense the moisture content of the clothes load and reset said counter at a rate proportional to the sensed moisture content;
said moisture sensing means comprising
a conductivity sensor arranged to contact the fabric load and a microcomputer input/output port means for charging a capacitance means;
said capacitance means arranged to discharge through said conductivity sensor;
said port means arranged to selectively read the charged value of said capacitance means and reset said counter if said charged value is less than a predetermined value; and
control logic means for terminating the drying operation upon accumulation of a preselected count in said resettable counter.

2. The control circuit of claim 1, wherein said capacitance means is arranged to discharge through said conductivity sensing means while and for a preselected time period after said capacitance means is charged.

3. The control circuit of claim 1, wherein said moisture sensing means operates at low voltage levels.

4. The control circuit of claim 1, further including means for selectively adjusting said preselected count which must be accumulated to terminate said drying operation.

5. In a fabric treatment apparatus having means defining a fabric treatment zone and means for treating fabrics placed therein to a predetermined condition, a microcomputer based control for terminating said treatment operation comprising:
a source of timing signals;
a counter arranged to be incremented in accordance with pulses derived from said source of timing signals;
sensing means associated with said fabric treatment zone for sensing a parameter related to said predetermined fabric condition and operative to reset said counter at a rate dependent upon the level of said sensed parameter;
said sensing means comprising
sensing means arranged to contact the fabric load;
a tri-stated port means on said microcomputer controlled to selectively charge a capacitance means;
said capacitance means electrically connected to said sensing means to discharge through said sensing means;
said tri-stated port means on siad microcomputer further controlled to selectively read the charged value of said capacitance means;
means for resetting said first counter if said charged value read is less than a predetermined value; and
circuit means for terminating said fabric treatment operation in response to the accumulation of a preselected count in said counter.

6. In a fabric drying apparatus having means defining a fabric drying zone and means for drying fabric placed hterein to a predetermined moisture level, a control for terminating said treatment operation comprising:
a source of timing signals;

a counter arranged to be incremented in accordance with pulses derived from said source of timing signals;

sensing means associated with said fabric drying zone for sensing the conductivity of said fabric load and operative to reset said counter at a rate dependent upon the level of said sensed conductivity;

said sensing means comprising:

conductivity sensing means arranged to contact the fabric load;

circuit means arranged to first output a voltage to charge a capacitance means, to second present a high impedance for a preselected period and to third read a remaining charge on said capacitance means, said capacitance means arranged to discharge through said conductivity sensing means while said circuit means is presenting a high impedance;

means for resetting said counter if said read charge is less than a predetermined value; and circuit means for terminating said fabric treatment operation in response to the accumulation of a preselected count.

7. The fabric treatment apparatus of claim 6, wherein said circuit means comprises a tri-stated port on a microcomputer.

8. A method of controlling a fabric drying apparatus having a drying zone and means for effecting at least one fabric drying operation, which includes the steps of:

(a) initiating a fabric drying operation;

(b) sensing the moisture content related to the condition of the fabric at a sensor within the drying zone;

(c) charging a capacitor from a tri-stating port on a microcomputer;

(d) discharging said capacitor through said sensing means;

(e) reading the charge remaining on said capacitor at said tri-stating port;

(f) translating the charge read at said tri-stating port into a measrue of the moisture content sensed; and (g) terminating the fabric drying operation when said measure of the moisture content reaches a preselected level.

9. The method of claim 8, wherein step (f) includes the steps of:

(1) counting pulses from a source of timing signals on a counter; and (2) repeatedly terminating and restarting the count in the counter in response to a charge remaining on said capacitor less than a predetermined amount as a measure of the moisture content.

* * * * *

UNITED STATES PATENT AND TRADEMARK OFFICE

CERTIFICATE OF CORRECTION

PATENT NO. : 4,422,247

DATED : December 27, 1983

INVENTOR(S) : Clifford L. DeSchaaf

It is certified that error appears in the above-identified patent and that said Letters Patent are hereby corrected as shown below:

Column 8, claim 5, line 55, before "microcomputer" delete "siad" and insert --said--.

Column 8, claim 6, line 66, before "to a predetermined moisture" delete "hterein" and insert --therein--.

Column 10, claim 8, line 17, before "of the moisture content" delete "measrue" and insert --measure--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*